US008468613B2

(12) United States Patent
Harty

(10) Patent No.: US 8,468,613 B2
(45) Date of Patent: Jun. 25, 2013

(54) MODULAR NECK PROTECTION DEVICE

(76) Inventor: Robert D. Harty, Mokena, IL (US)

( * ) Notice: Subject to any disclaimer, the term of this patent is extended or adjusted under 35 U.S.C. 154(b) by 140 days.

(21) Appl. No.: 12/982,621

(22) Filed: Dec. 30, 2010

(65) Prior Publication Data

US 2011/0162131 A1 Jul. 7, 2011

Related U.S. Application Data

(63) Continuation-in-part of application No. 10/687,162, filed on Oct. 16, 2003, now Pat. No. 7,861,326.

(51) Int. Cl.
*A41D 13/00* (2006.01)

(52) U.S. Cl.
USPC ..... 2/468

(58) Field of Classification Search
USPC ..... 2/456, 171.2, 69, 205, 410, 468, 2/425, 202, 207, 208.7, 209.13, 209.4; 601/79; 602/74, 75; 482/10, 11, 93; 607/109, 110, 607/112, 139
See application file for complete search history.

(56) References Cited

U.S. PATENT DOCUMENTS

| | | | | |
|---|---|---|---|---|
| 3,900,896 | A * | 8/1975 | Ackerman | 2/468 |
| 4,075,714 | A * | 2/1978 | Ryder et al. | 2/6.3 |
| 5,215,080 | A * | 6/1993 | Thomas et al. | 607/112 |
| 5,421,035 | A * | 6/1995 | Klose et al. | 2/411 |
| 6,006,368 | A * | 12/1999 | Phillips | 2/468 |
| 6,481,026 | B1 * | 11/2002 | McIntosh | 2/468 |
| 6,874,170 | B1 * | 4/2005 | Aaron | 2/468 |
| 8,176,574 | B2 * | 5/2012 | Bryant et al. | 2/424 |

* cited by examiner

*Primary Examiner* — Tejash Patel
(74) *Attorney, Agent, or Firm* — Cherskov Flaynik & Gurda LLC

(57) ABSTRACT

The invention further provides a device to protect the neck and the base of the skull of a person, the device comprises an impact-resistant substrate and a helmet. The impact-resistant pliable substrate is adapted to encircle an extended portion of the person's neck and lower cranium. The helmet is configured to cover the skull of the person, except for the occipital region of the skull. The helmet is adapted to receive the first impact-resistant pliable substrate such that the substrate substantially covers the occipital region of the skull and cervical vertebra of wearer.

14 Claims, 7 Drawing Sheets

MODULAR NECK PROTECTION DEVICE

CROSS REFERENCE TO RELATED APPLICATIONS

This application is a Continuation in Part of U.S. Utility patent application Ser. No. 10/687,162, filed on Oct. 16, 2003, which issues as U.S. Pat. No. 7,861,326 on Jan. 4, 2011.

BACKGROUND OF THE INVENTION

1. Field of the Invention

The present invention relates to the field of neck protection and, more particularly, the invention relates to devices that protect a person's head and neck while he or she engages in a variety of activities.

2. Background of the Invention

The human brain and spine are very vulnerable to injuries to the back of the head and particularly to the base of the skull. This is a most critical area for it is there that the spinal cord emerges from the brain. Injury to the spinal cord threatens every aspect of human physiology: control of respiration, heart rate, body temperature, consciousness, swallowing, vaso-constriction and dilation, and a myriad other autonomic nervous system functions. Concussions to the brain, and/or injury to the brain stem, cervical spine, and spinal cord may result in paralysis and even death.

The neck and the base of the human head are frequently injured in a variety of sports and other physical activities. Present practice is to provide the sports participant with a helmet designed to protect the top of a person's skull. However, helmets provide little protection to a person's neck (i.e., cervical spine) or base of the skull. Notable examples are helmets intended for hockey, bicycling, football, baseball, roller blading, car-racing, and canoeing.

Furthermore, many helmets on the market actually exacerbate injury to the neck, for example during severe whiplash or hyperextension situations. In such situations, the depending horizontally disposed ridge of the back of the helmet collides with the brain stem, causing injury or death.

There are several neck supports available. Many of these fail to provide protection to the critical area where the spinal cord meets the base of the skull. (See e.g. U.S. Pat. No. 3,921,626 to Neel and U.S. Pat. No. 4,576,150 to Auracher). Others are intended to immobilize the head by the use of a rigid structure (U.S. Pat. No. 3,713,657 to Presta).

None of the above devices are intended to be potentially integrated with a head-protection system that includes a helmet.

U.S. Pat. Nos. 4,638,510 and 6,009,566 issued to Hubbard on Jan. 27, 1987 and Jan. 4, 2000 respectively, disclose a neck protection device for use with a race car. Known as the HANS device (acronym for Head And Neck Support), this instrument restricts forward motion of the skull in sudden, forward impact scenarios. As such, the device includes a restraining yoke which extends down the ventral torso of a seated driver. However, many drivers do not use the device because it compromises vision and range of motion.

A need exists in the art for a device to simultaneously protect the head and neck, and therefore the brain, brain stem, and the upper spinal cord, from injury. Such a device would be modular in that a portion of it protects the neck, with that portion removably attached to a head protection portion (such as a myriad of a sports helmets and/or helmet liners). The device would enable a wearer to walk, run, tumble, drive and cycle while maintaining complete mobility. Such a device also would not impede access to the trachea, ears, face and other areas so as to facilitate observation and treatment of these areas if an injury should occur.

SUMMARY OF THE INVENTION

It is an object of the present invention to provide a device for protecting the neck and the base of the skull of a person engaged in sports or in other physical activities that overcomes many of the disadvantages of the prior art.

It is a further object of the present invention to provide a device for protecting the neck and the base of the skull of a person engaged in sports or in other physical activities that may be utilized with different sized persons. It is a feature of the present invention that it includes an adjustable strap. An advantage of the present invention is that it ensures that a team equipped with enough standard specimens of the present invention will be able to accommodate all its members.

Another object of the present invention is to provide a device for protecting the neck of a person engaged in sports or in other physical activities that allows treatment of the person's trachea while the person is wearing the device. A feature of the present invention is a shield to protect the cervical area of a patient and a similar but detachable shield to protect the front of the neck of the patient. An advantage of the present invention is that it allows for an emergency tracheotomy while the person is still wearing the device.

Yet another object of the present invention is to provide a device for protecting the neck and the base of the skull of a person engaged in sports or in other physical activities that does not impede blood flow while the person is wearing the device. A feature of the present invention is that it includes person contact points at a multitude of locations thus distributing the force exerted by the device. An advantage of the present invention is that it eliminates the danger of excessive contact pressure occurring at one or more body points while the device is worn.

A further object of the present invention is to provide a device for protecting the neck of a person engaged in sports or in other physical activities that allows unimpeded motion of the person's head, either side-to-side, or front-to-back, while the person is using the device. It is a feature of the present invention that it includes non-rigid materials to facilitate motion of the head. An advantage of the present invention is that it allows unimpeded vision and motion while also conferring maximum protection to those moving anatomical structures.

Still another object of the present invention is to provide a device for protecting the neck and the base of the skull of a person engaged in sports or in other physical activities who is also wearing a helmet. It is a feature of the present invention that it includes means to attach the invented device to a helmet. Alternatively, the invention can be integrally molded or permanently attached to the helmet. An advantage of the present invention is that it facilitates simultaneous protection of the entire skull and neck by extending head protection conferred by the helmet to those areas.

Yet another object of the present invention is to provide a device for protecting the neck and the base of the skull of a person engaged in sports or in other physical activities who is wearing a helmet or some type of head protection. It is a feature of the present invention that it may extend under any helmet of head covering. An advantage of the present invention is that it allows use of the same device for protecting the neck and the base of the skull of a person engaged in a variety of sports or in other physical activities which require wearing different helmets, and without the necessity of modifying those helmets or the neck protector.

Another object of the present invention is to provide a device which covers all but the occipital region of the skull with a rigid helmet, while simultaneously covering the occipital region with a less rigid, more reversibly deformable substrate. A feature of the device is that all aspects of the skull are covered simultaneously. An advantage is that the base of the skull and the cervical region is continuously protected (even though the helmet does not extend to the base of the skull) while any danger of the bottom edge of the helmet digging into the cervical area in instances of whiplash or hyperextension is simultaneously removed.

Briefly, the invention provides a modular device to protect the neck and the base of the skull of a person engaged in sports or in other physical activities. The device may be used by a person who is also wearing a helmet. The device comprises an outer impact-resisting pliable first substrate for protecting the back and the sides of the person's neck; a second cushioning substrate in communication with the first substrate, whereby the second substrate is adapted to encircle the person's neck; and a strap equipped with fastening means to provide closure of the device around the person's neck.

The invention also provides a device for imparting physical protection and predetermined temperature application to the human neck, the device comprising a first substrate extending along the vertebra column of the region; a second substrate integrally molded to the first substrate and extending along lateral portions of the neck; and a means for positioning cold packs or hot packs within the device so as to effect the temperature of the neck.

The invention further provides a device to protect the neck and the base of the skull of a person, the device comprising: an impact-resistant pliable substrate whereby said substrate is adapted to encircle an extended portion of the person's neck and lower cranium; and a helmet configured to cover the skull of the person, except for the occipital region of the skull, said helmet adapted to receive said first impact-resistant pliable substrate such that the substrate substantially covers the occipital region of the skull and cervical vertebra of the person.

BRIEF DESCRIPTION OF THE DRAWING

The foregoing invention and its advantages may be readily appreciated from the following detailed description of the invention, when read in conjunction with the accompanying drawing in which.

DETAILED DESCRIPTION OF THE INVENTION

The present invention provides a modular device to protect the neck and the base of the skull of a person engaged in sports or in other physical activities who is also wearing a helmet. The device can be worn separately, with regular headwear (i.e., with its upwardly extending end 26 tucked underneath a baseball cap), or in conjunction with a helmet. The device could be worn so that a downwardly depending end is left unfastened.

Embodiments of the invention confer different kinds of protection for different parts of the head and spine of the wearer. For example, in one embodiment, a hard shell helmet protects all regions of the wearer's skull but for the occipital region. In that corresponding region of the helmet, a gap exists, shaped as an inverted "V" or "U". Mated with that inverted V gap is removably positioned a just as protective but more flexible substrate as described herein. This substrate attaches to the helmet and depends therefrom to protect the cervical spine of the wearer. Generally, the apex of the notch or of the inverted V may be positioned as high as the middle of the back of the head, but generally substantially along the bottom half of the height of the back of the head. Specifically, in one embodiment, the apex of the notch or V may start where the suture lines of remnants of the lambdoid fontanel of the skull is located. This suture, also shaped as an inverted V, separates the occipital bone from the two parietal bones of the skull.

This v-notch helmet/hanging substrate combination confers continuous and simultaneous protection to the wearer extending from the forehead (i.e., the front of the skull) to and over the cervical-, and even to and over the thoracic-region of the spine. An embodiment of the invention includes a helmet/substrate combination wherein the helmet and/or substrate is radiolucent to allow x-raying or other imaging procedures without having to remove the device from the wearer.

Substrate Detail

Figure 1:
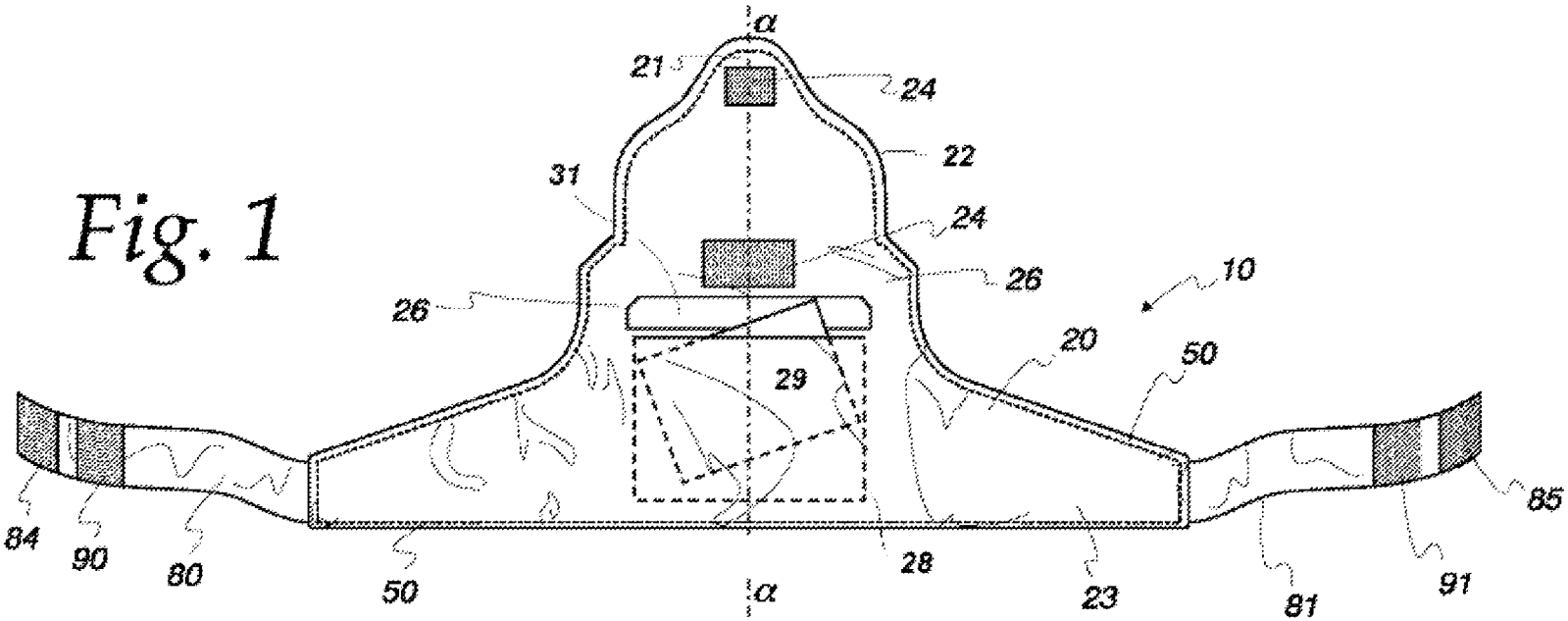
FIG. 1 is a plan view of an outwardly facing (i.e. dorsal) surface of a neck protection device in an unfastened configuration, in accordance with features of the present invention.

As shown in FIG. 1, the substrate portion of the head and neck protection device, is generally designated as 10, and is comprised of three components: an outer impact-resistant pliable substrate 20, a cushioned (i.e., reversibly deformable) lining 50, and closure straps 80, 81. Generally, the outer substrate is rigid, but it also can be a dense pliable material. Exemplary materials for use as an outer substrate includes, but is not limited to, plastics, leather, wood, metal, fiberglass, carbon composite, aramid fiber substrates including but not limited to poly para-phenyleneterephthalamide (i.e., Kevlar®), and combinations of these materials.

While the substrate portion of the device is illustrated with the three components integrally molded with each other, the components can be removably attached (i.e., via a hook-and-pile configuration) and juxtaposed to each other. Also, the cushioned lining may be omitted if an outer pliable substrate is used and is sufficiently soft. Another alternative is to provide cushioning only along the edges of the substrate 20. An embodiment of the device is where the substrate and the helmet are integrally molded as one piece.

The substrate 20 has a first upwardly extending end 21 and a downwardly depending end 23. While the upwardly extending end 21 is adapted to attach to a helmet, the downwardly depending end can either remain free hanging, so as to extend down the back of the user (reminiscent of a raccoon tail cap) or else attached to the user via a plurality of neck straps 80, 81 as discussed herein.

Referring to FIG. 1, a first embodiment of the substrate of the device extends between the wearer's shoulders at from approximately the first thoracic vertebra to approximately the base of the wearer's cranium. Typically an upwardly extending region 21 of the substrate device 10 would extend under the depending edge of a helmet if the person using the device wears one. In an embodiment, the helmet is a typical one, in that its depending back edge opposes the area of the neck directly overlying the cervical vertebra. Some exemplary helmet configurations oppose (i.e., overlay) a region of the neck between the first and seventh cervical vertebra, or between the first and fifth cervical vertebra, or between the first and the third cervical vertebra. Generally, a helmet with a depending edge overlaying any one of the seven cervical vertebra is suitable. For example, if the depending edge of the helmet directly opposes the fourth cervical vertebra, cervical vertebra 1-4 are covered by the helmet, while cervical vertebra 5-7 are not covered by the helmet.

Figure 7:
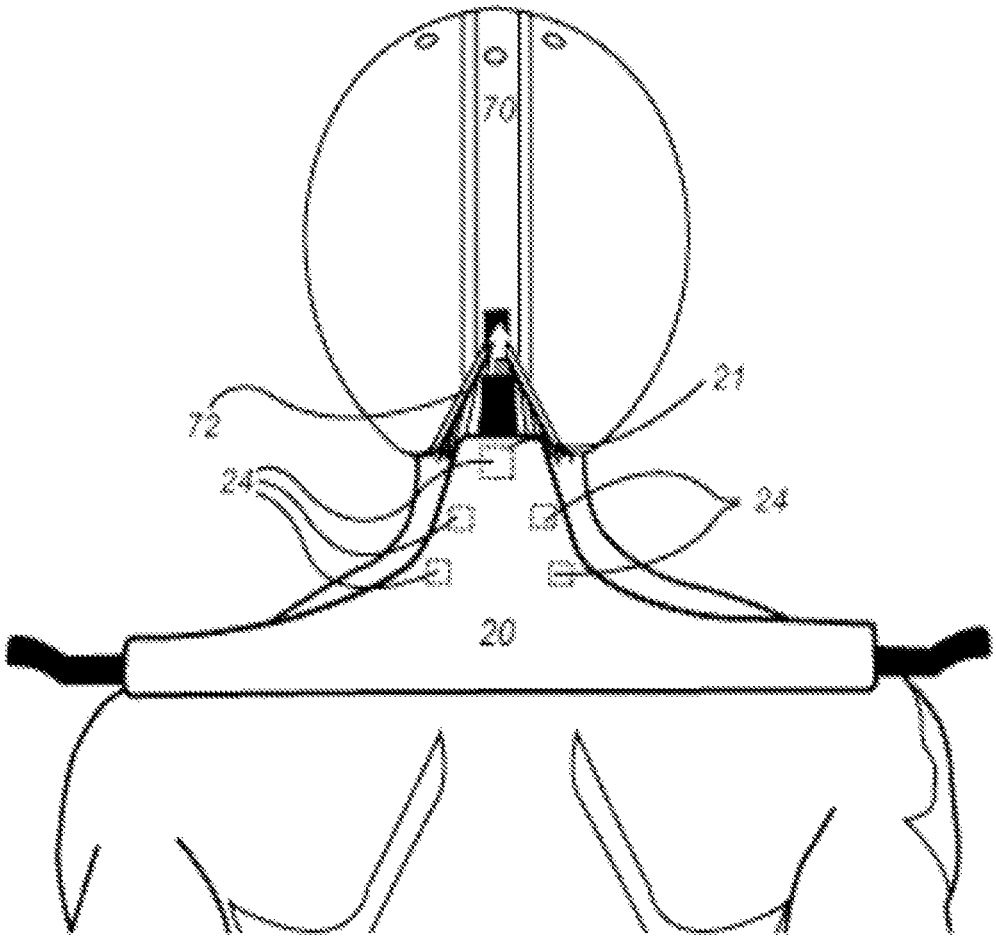
FIG. 7 is an exploded view of a helmet in mating relation with a depending substrate, in accordance with features of the present invention.
Figure 9:
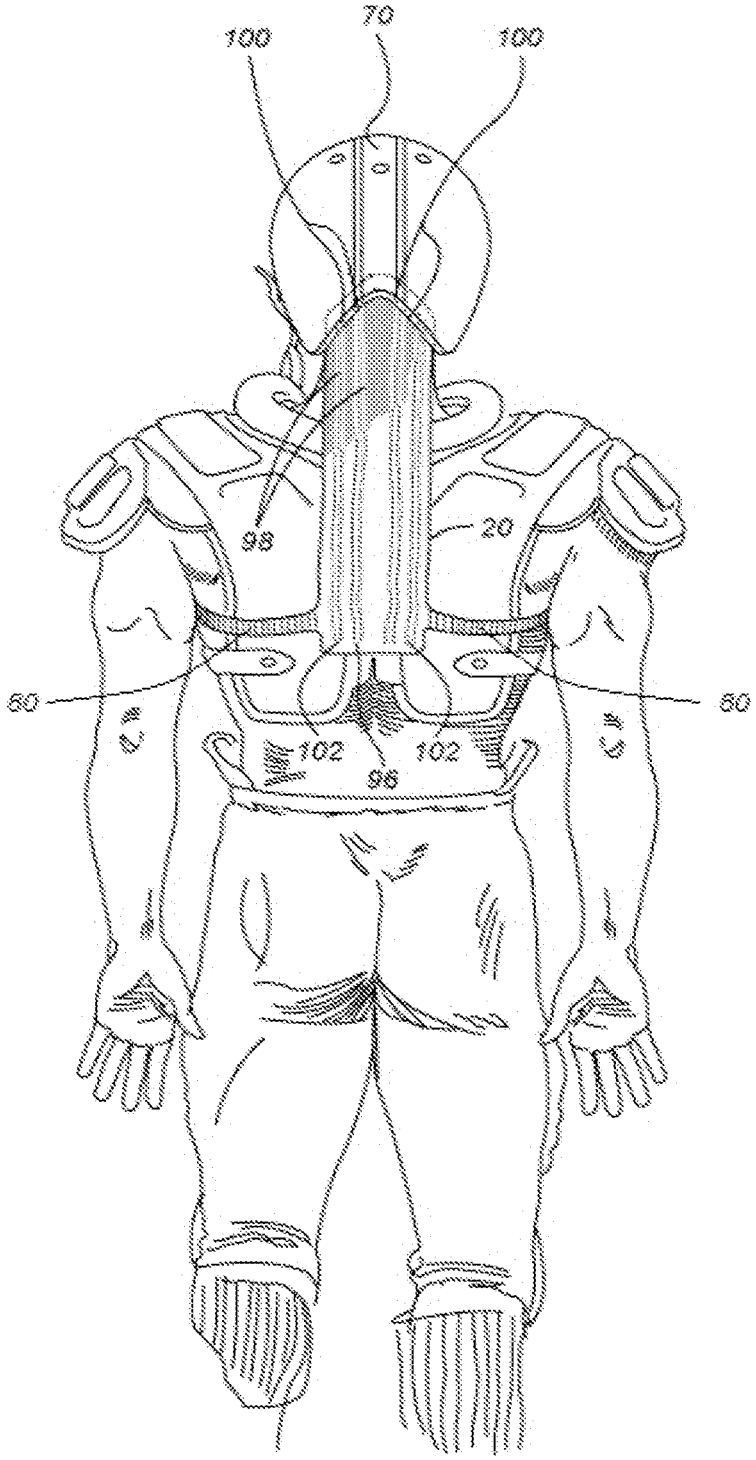
FIG. 9 is a partial cutaway of FIG. 8, taken along lines 9-9.
Figure 10:
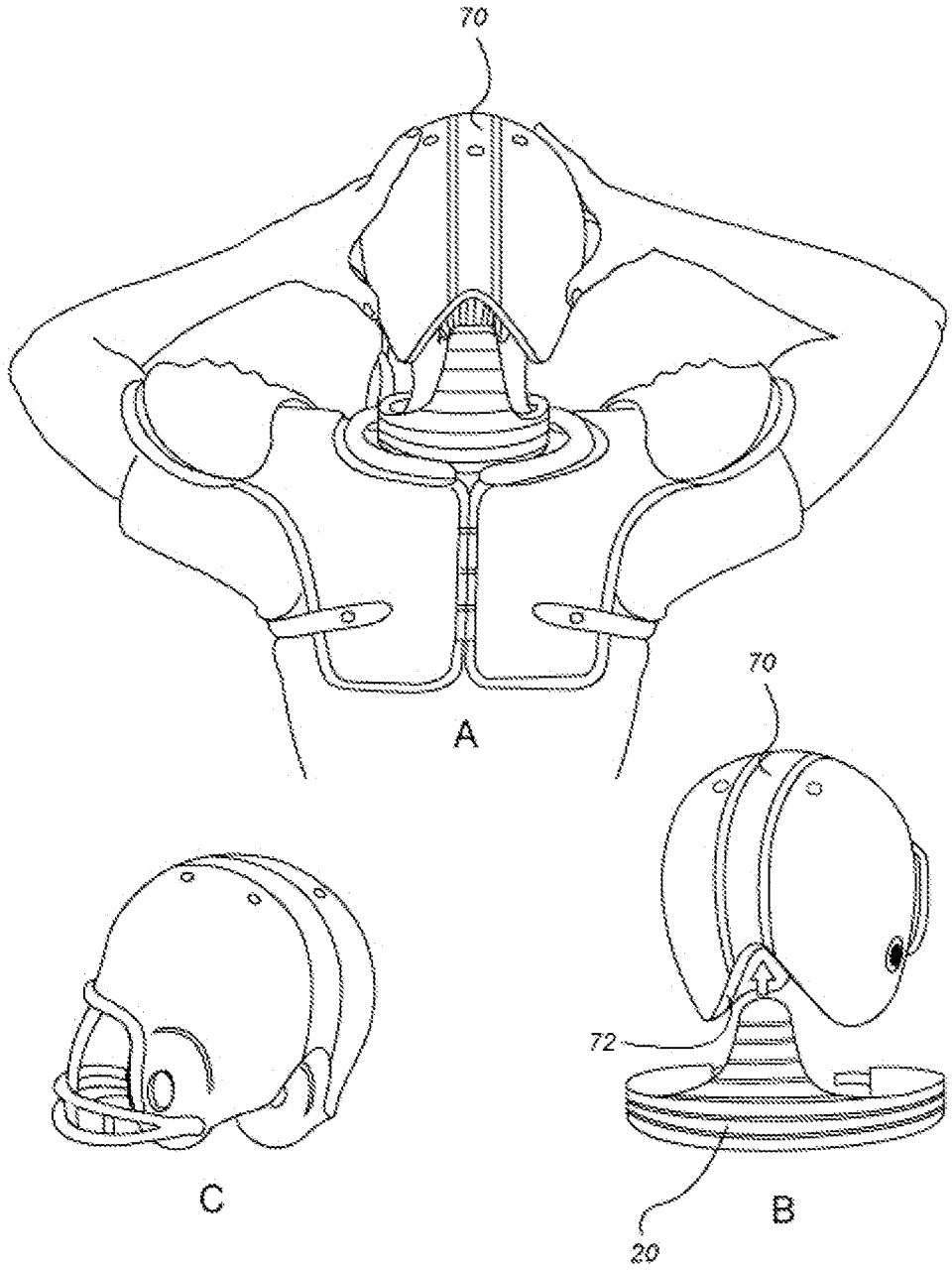
FIG. 10A is an exploded view of the notched helmet-spine protecting substrate embodiment of the invention, as the wearer is putting on the helmet, in accordance with features of another embodiment of the present invention.
FIG. 10B is a perspective view of the embodiment depicted in FIG. 10A.
FIG. 10C is a perspective view of solely the invented helmet whereby the helmet confers rigid protection to all but the occipital region of the skull, in accordance of features of the present invention.

In another embodiment, discussed infra, the helmet is an atypical one in that it lacks a depending edge along the dorsal (posterior) region of the neck. The back of this helmet defines an inverted V or U such that it does not overlay the occipital region of the skull. FIGS. 7 and 9 most clearly depict this helmet configuration.

A hook-and-pile configuration, snap fit configuration, peel-and-stick substrate or other reversible substrate attachment means 24 is adapted to be received by complementary surfaces or adaptable surfaces affixed to a helmet. The fact that the support provided by the substrate extends to the base of the cranium and under a depending edge of the helmet (for example the helmets depicted in phantom outline in FIG. 6B, or those depicted in FIGS. 7 and 9) affords continuity (i.e., unbroken) neurological protection from the top of the head (conferred by a typical high impact helmet) down to the middle of the shoulder blades.

Lateral to the longitudinal axis (designated as $\alpha$) of the support, the surface 20 curves inwardly to form a pair of opposing concave surfaces 23. The concave surfaces 23 are adapted to envelop at least part of the lateral portions of the neck, particularly around and below the jaws. The substrate 20 may be chosen to extend ventrally when worn so that a forward-facing edge of the device terminates just behind the ears.

To maximize head mobility, these concave-forming surfaces 23 preferably are comprised of a less rigid material than the region 26 of the device directly opposing or immediately adjacent the cervical and thoracic vertebra regions of the wearer.

Figure 5:
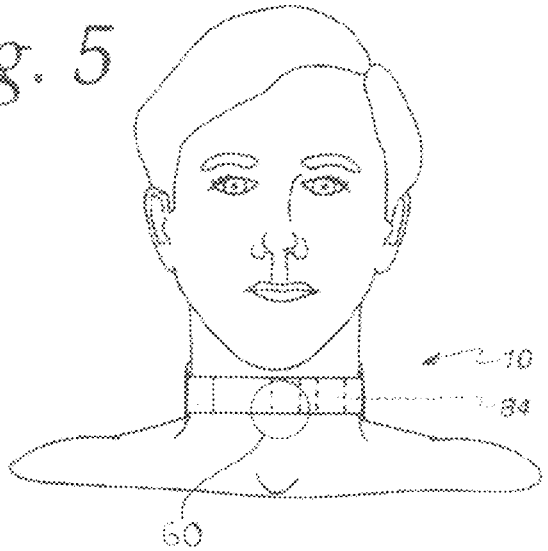
FIG. 5 is a front view of a person wearing a first embodiment of a neck protection device in a fastened configuration, in accordance with features of the present invention.
Figure 6A:
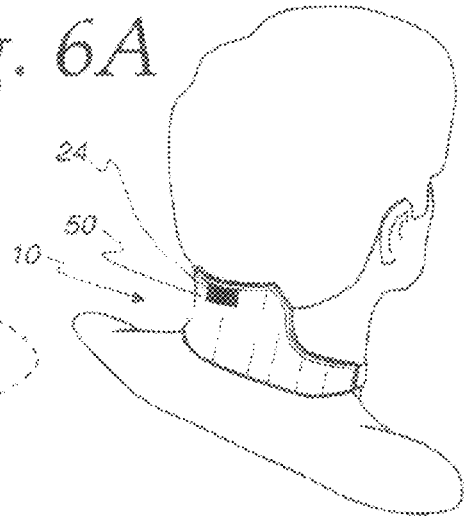
FIG. 6A is a rear view of a person wearing a first embodiment of a neck protection device in a fastened configuration, in accordance with features of the present invention.

FIGS. 5 and 6A show front and rear views of a person wearing the substrate without a helmet.

Figure 2:
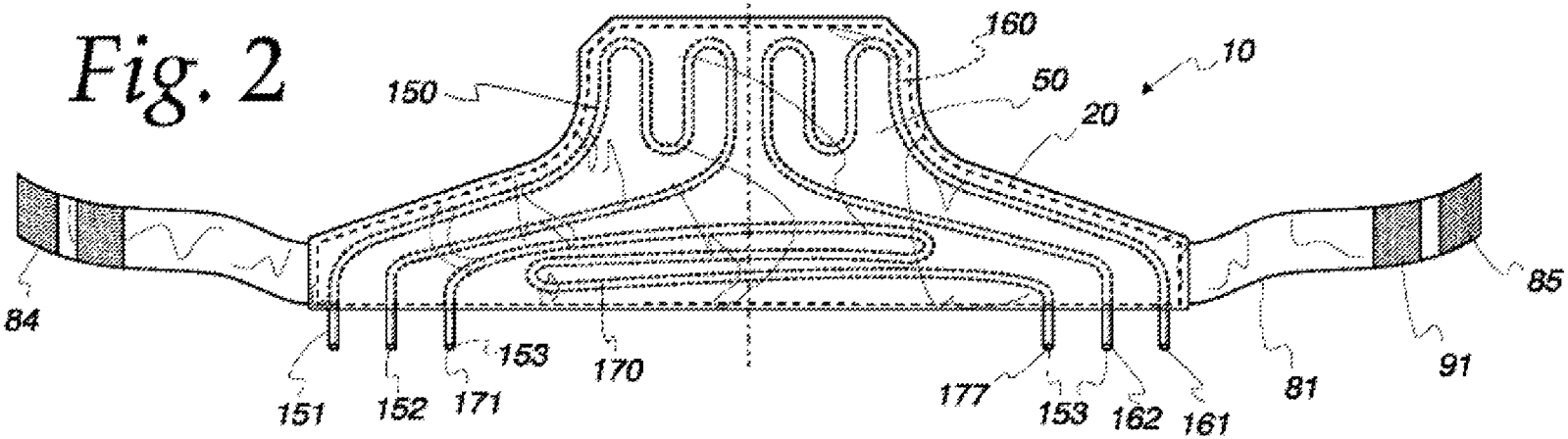
FIG. 2 is a plan view of a wearer contact surface of a neck protection device, also shown in an unfastened position, in accordance with features of the present invention.

FIG. 2 is a planar view of the inside surface (i.e. the surface contacting the person) of the present invention in an open configuration. The external surface 20 of the protective substrate is lined with an inner cushioning lining 50 such as rubber foam, gel, or an inflatable cushion.

The inflatable cushion can include an inflatable bladder or series of bladders or conduits adapted to receive fluid of various temperatures and phases (i.e. gas and liquid). For example, the lining 50 may comprise a plurality of reversibly deformable substrates, such as plastic conduits or sacs, which may receive any suitable fluid such as air (for cushioning), a heated fluid (such as heated gas or heated liquid), a cooled fluid (such as cooled gas or cooled liquid), or a combination of such fluid phases and temperatures. Exemplary gaseous fluids include, but are not limited to, air, nitrogen, noble gases, and a combination of these. Exemplary liquid fluids include, but are not limited to, water, vegetable oil, mineral oil, liquid-solid combinations such as water-based deformable low density gel compositions, plasticizers with a plurality of particulates dispersed therein, deformable gel compositions comprising carbopol and water/glycerin, emulsions, and combinations of these substances.

The embodiment depicted in FIG. 2 comprises a plurality of tubes 150, 160, and 170, for the right, left, and bottom sides respectively of the lining 50. These tubes each have an inlet 151, 161, and 171, respectively, and an outlet 152, 162, 172, the outlets facilitating the filling of the tubes. The three-tubes configuration allows the application of different fluids to different areas of the neck if necessary. If only fluid is used, one may join two or three tubes in series or in parallel. Other tubing arrangements can be used as well. Each of the conduits is provided with a means 153 for regulating fluid flow through the conduits. These means include standard valves such as those available through Halkey-Roberts (St. Petersburg, Fla.).

Not only will fluid-filled bladders or conduits provide cushioning means, but the fluids, if preheated or precooled, also can provide a means for warming or cooling the body surface of the wearer at that skin-contact location. The aforementioned fluid-filled bladders also are of the form which are removably inserted into a pouch 28 formed by one of the substrates comprising the device. Such bladders can include typical hot packs or cold packs 29 used by athletes, hikers, and those suffering from ailments alleviated by cold- or hot-temperature treatment. Such hot packs and cold packs are widely available commercially, such as from American Therapeutic Supply (Colorado Springs, Colo.).

The provision for a pocket or pouch to receive the temperature packs is a means to impart heat or cold to the neck, when such packs are inserted. As depicted in FIG. 1, one means for receiving a hot- or cold-pack is a pouch or pocket 28 formed by a portion of the region 26 of the substrate overlaying the cervical vertebra. The pouch can be formed of a transparent material so as to notify the wearer or observers of changes in pack conditions, for example in situations where the pack changes colors as it gains or loses heat. The cervical/thoracic vertebra protective region of the substrate also can be constructed of a material so as to accommodate team logos, reflective material, or other visual cues. Closure of the pouch (from the top as shown, or from the bottom or sides) is effected in a variety ways, including hook and pile closure configurations, zippers, snaps, or tongue-and-groove devices (i.e. Zip-Loc™ devices) 31. Such pocket-closure configurations facilitate replacement of packs while the substrate and/or any associated helmet is still being worn and/or while the substrate is connected to the helmet.

Aside from adapting an outside surface (i.e., a surface seen by an observer of the wearer) to receive a cold- or hot-pack, an inside surface 50 of the substrate (i.e., a surface 50 which contacts the wearer's skin) as seen in FIG. 2, also can define a receiving pocket. In this later instance, the pack can also serve as a cushioning means, said means thus situated intermediate the wearer and the rigid substrate comprising the cervical protective region of the device.

In an embodiment of the invention, the inside surface or lining 50 defines the wearer's side of a first layer which comprises a hot or a cold pack. This first layer attaches to or is integrally molded to the second layer i.e. the outer impact-resistant pliable substrate 20. In embodiments where the first layer is a hot or cold pack integrally molded to the outer impact-resistant pliable substrate, the entire two layer embodiment can be first loaded with fluid (such as a gel) or fluid-filled sacs, then second, placed in a freezer or refrigerator to be cooled, or in an oven/microwave to be heated, then third, removed from the refrigerating/heating means just prior to attachment to the helmet.

It should be noted that the lateral portions of the substrate which encircle the neck also can be adapted to contain fluid circulation means or the skin-temperature modifying packs, as described supra. It should be further noted that the circulating fluid or skin temperature modifying packs can be confined to certain regions of the substrate so as to allow other regions of the device to be maintained at ambient temperatures. This arrangement allows other regions of the substrate to be subjected to different fluids, or different temperatures, thereby conferring different temperature zones in different regions of the device.

The neck protection device is worn by encircling and then securing the straps 80 and 81 around the neck. The ends of the straps are reversibly joined via such reversible attachment means as hook and pile configurations, snaps or zippers.

Figure 3:
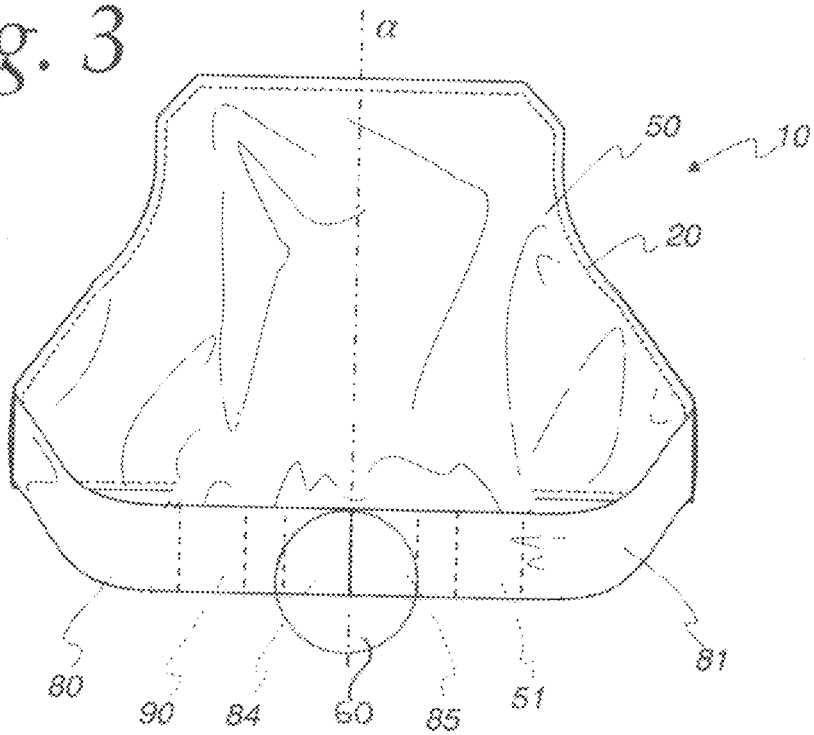
FIG. 3 is a plan view of a wear-contact surface of a the modular neck protection device in fastened configuration, in accordance with features of the present invention.

As illustrated in FIG. 3, the neck protection substrate optionally includes a tracheal shield 60 that may be removably attached to the straps 80, 81. In the alternative, the tracheal shield may be permanently attached to either strap 80 or 81. The shield is provided to protect the front of the neck generally, and the trachea specifically, from trauma due to blunt force or if the wearer should fall forward.

Optionally, the tracheal shield comprises a durable outer substrate (not shown) facing away from the wearer's neck, and a cushioning inner substrate (not shown) facing toward the wearer's neck. Inasmuch as the durable outer substrate is selected to protect the neck from frontal falls or blows, the substrate would be of a similar material to that which comprises the surface defining the cervical shield region (i.e., the back of the neck) 26 of the substrate. An outward facing surface of the shield could comprise a light, a reflector, highly visual colored surface, or some similar safety enhancement feature.

Figure 4:
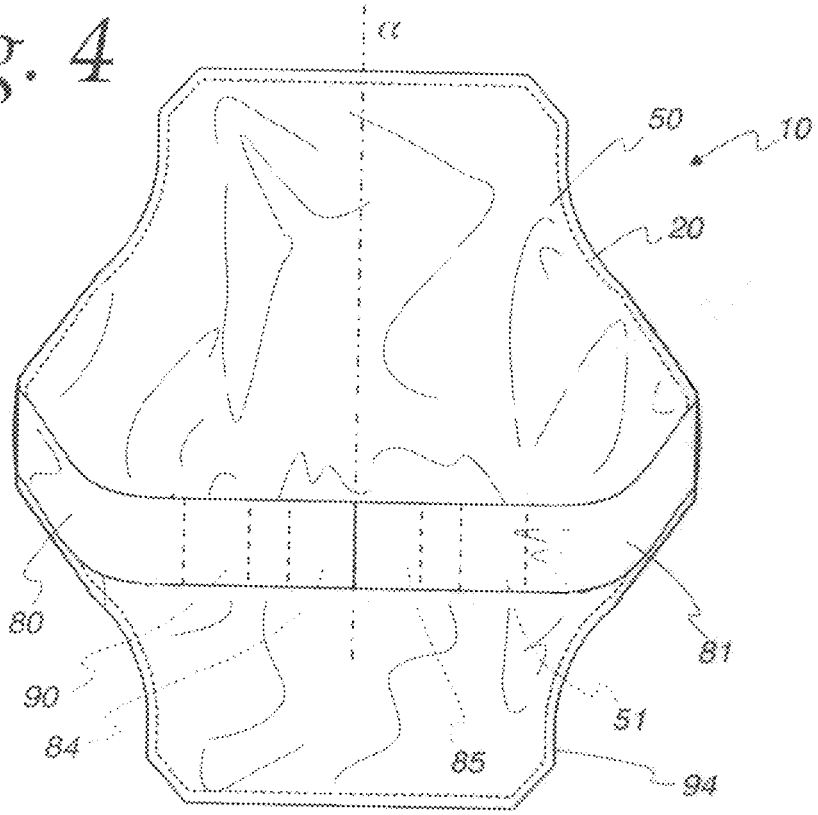
FIG. 4 is a plan view of an outwardly facing surface of another alternative embodiment of a neck protection device in a fastened configuration, in accordance with features of the present invention.

FIG. 4 shows a front view of another alternative embodiment of the substrate. As shown, a depending portion 94 of the cervical protective region 26 device extends down the dorsal surface (back surface) of the neck in a direction away from the base of the skull, so as to terminate in a region approximately between the wearer's shoulder blades. Preferably, the depending portion ends at approximately the middle of the shoulder blades of the wearer, i.e. below the wearer's 7th vertebra. The substrate also encircles the patient's neck to confer positional stability of the device along the dorsal portion of the neck.

Figure 6B:
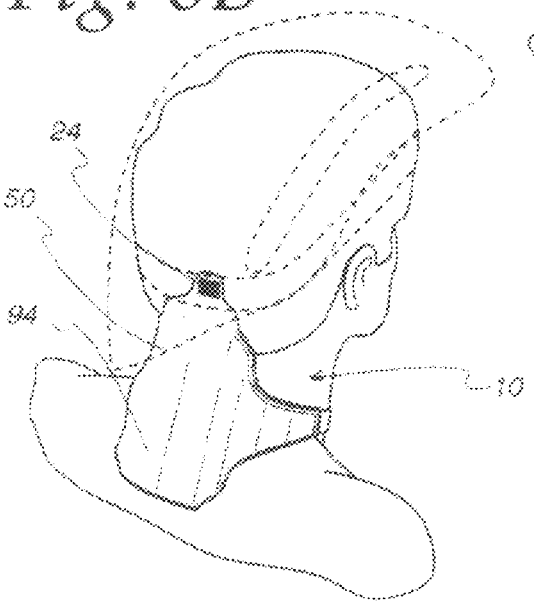
FIG. 6B is a rear view of a person wearing an alternative embodiment of a neck protection device in a fastened configuration and with a helmet, in accordance with features of the present invention.

FIGS. 5 and 6B show front and rear views of a person wearing the embodiment of this invention depicted in FIG. 4.

As noted supra, the free ends (i.e. terminal ends) of the straps 84 and 85 may be configured into complementary reversible attachment means such as hook-and-pile fastening configurations, belt and buckle arrangements, snap fit arrangements or by other similar fastening means. For additional security, additional fastening means 90, 91 situated proximal from the terminal ends can be provided.

A variety of materials may be used for the outer substrate, and similarly for the lining. Reversibly deformable material, but nevertheless shock resistant material, could be used as the outer substrate. Suitable materials include plastics including nylons, such as poly-para-phenylene terephtalamide, marketed as Kevlar® by the Du Pont Corporation. Both transparent and non-transparent materials may be used. However distinct advantages accrue when both the outer substrate and the inner lining consist of transparent materials. This allows visual inspection of the neck if the person suffers an injury. Transparent substrates also allow for the quick detection of hemorrhaging or other injury. Also, it is preferable that the entire device be radio-translucent and x-ray transparent.

Generally, it is assumed that both the outer substrate and the cushioning materials consist of plastics but a multitude of materials satisfy the above requirements. Foam- and gel-like materials are especially appropriate for the cushioning substrate.

Any flexible substrate is a suitable strap constituent. As such, exemplary materials include, but are not limited to, plastic, cloth, nylon, rubber, and leather. The person's comfort is enhanced if the straps consist of, or are lined with, a soft material. Exemplary soft materials include, but are not limited to cloth, rubber, sponge, plastics, other manmade products, leather, and combinations thereof. Again, the use of radio-translucent materials may be preferable in many applications.

The strap adjustment feature allows users to adapt just one device to a myriad of users so as to accommodate children or adults having a wide range of neck sizes.

The dimensions of the device may be chosen to accommodate different sports or activities and the device may be used with or without a helmet.

In operation, the user dons the device so that it rests in the position shown in FIGS. 5, 6*a* and 6*b*. It should be noted that while the wearer in FIGS. 5, and 6*a* is not wearing a helmet, the position of the device is the same when a helmet is worn, but for the interaction of attachment means 24 with the headgear.

In an embodiment of the invention, with or without the combination of a helmet, the substrate hangs benignly along the dorsal region of the cervical region of the wearer and is not "used" or otherwise utilized as a neck protection device. It is only until the wearer experiences a fall backward or is otherwise struck from behind. For example, cyclist accidents often turn fatal when the rider strikes the back of her neck against a curb or other uneven protrusion. The substrate is attached to the helmet to minimize its separation from the helmet in case of a fall by the wearer. As such, the substrate is attached to the inside surface of the helmet so that it resides intermediate the wearer and the helmet. Alternatively, the substrate is attached to an outside surface of the helmet at a surface of the helmet in close spatial relationship to the depending edge of the helmet which typically opposes the cervical area of the wearer and/or the occipital region of the skull of the wearer.

While the device can be modular in design so as to be worn with or without headgear, the device also can be permanently attached or molded with the headgear. This would minimize the possibility of separation of the device from the helmet, and also provide a more cosmetically pleasing extension of helmet material to the device.

As noted supra, however, while the device hangs benignly as a neck protection device, the device can serve as a means for imparting heat or cold temperatures to the wearer as soon as the device is donned by the wearer. This is especially valuable for athletes and others concerned with heat build-up in warm climes or muscle/joint stiffness in cold climes.

Helmet Detail

FIG. 7 depicts an embodiment of the invention which includes a helmet for covering all but occipital regions of the head. This helmet differs from the phantom helmet design depicted in FIG. 6B wherein the depending back edge 60 of that helmet extends downwardly to terminate at a point approximating the base of the skull.

FIG. 7 depicts the rearward portion of a helmet 70, in exploded view of an embodiment of the pliable substrate 20 mated with the helmet. (As noted elsewhere herein, the substrate may further comprise an inner cushioning layer 50.) In the embodiment shown in FIG. 7, the helmet 70 comprises rearward regions defining an open area or notch 72 adapted to matingly receive the substrate 20. As such, superior regions of the substrate are complementarily shaped to the notch. For example, as can be seen in FIG. 1, the upwardly extending sides 22 of the substrate are formed to nest within the notch of the helmet, or to slightly overlap the opening defining the notch.

In the embodiment shown, the notch is shaped as an inverted "V" or "U". This shape allows for hyperextension of the neck without a danger of a horizontally disposed bottom edge of a typical helmet digging into the base of the skull or the cervical region of the wearer.

Figure 8:
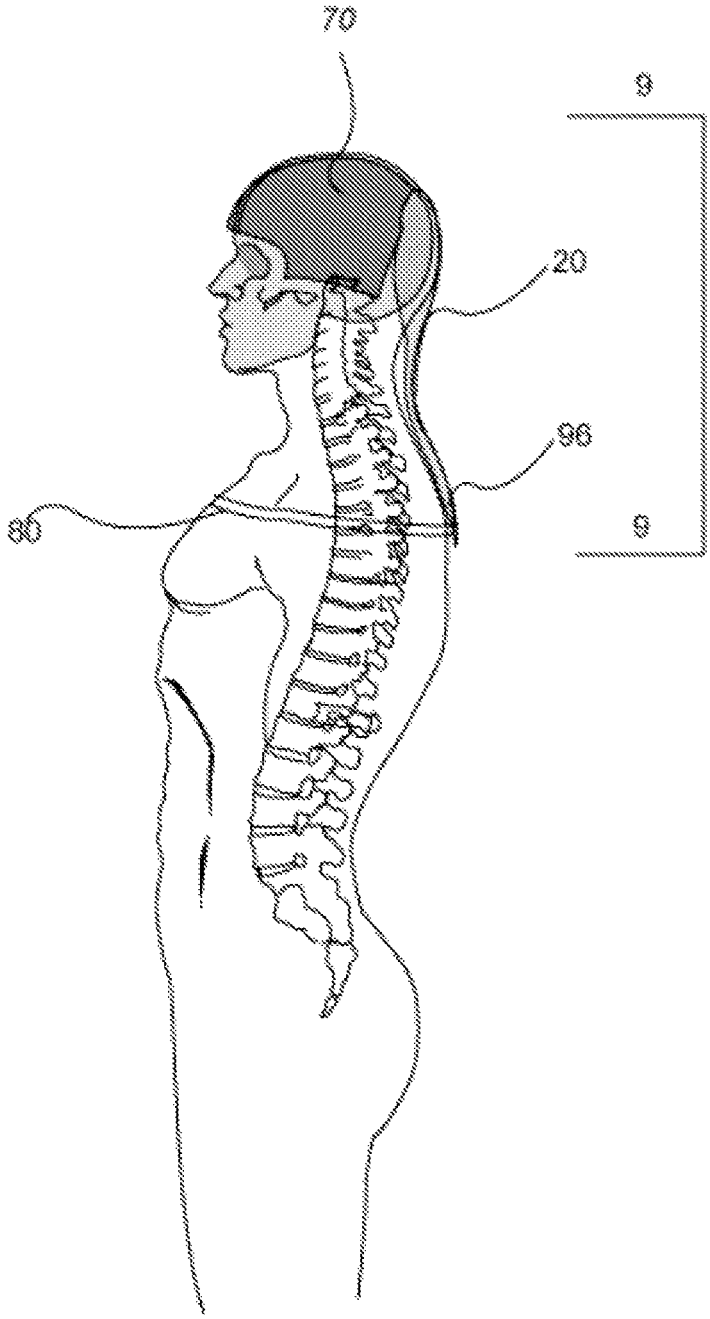
FIG. 8 is a side view of a helmet mated with a substrate, the depending end of which is shown terminating at a mid thoracic region of a wearer's spine, in accordance with features of an embodiment of the present invention.

In an embodiment of the invention, a depending region of the substrate would extend to and terminate at the mid-thoracic region of the wearer (for example, approximately between the fourth and ninth thoracic vertebra, which is approximately between the tenth and eighteenth vertebra). FIG. 8 depicts this embodiment wherein the substrate 20 originates at the notched portion 72 of the helmet 70, but extends downwardly to terminate at a mid-thoracic end 96. Comparatively speaking the depending end of this embodiment is situated inferior to the depending end 94 of the mid-cervical end substrate depicted in FIG. 6B. Optionally, this elongated embodiment is adapted to receive longitudinally extending rods 98 of a semi-rigid nature, those rods situated lateral from the substrate region directly overlying the spinal cord. These rods are reversibly deformable so as to be biased to their original unflexed (i.e., straight line configuration) position (seen in FIG. 8 and FIG. 9) during a neck hyperextension event.

A proximal end of the rods 100 may be attached to the helmet while a distal end 102 of the rods, encapsulated by the substrate, are held snuggly to the back of the wearer via the securing straps 80 which fasten the depending end 96 of the substrate 20 to the chest (anterior, ventral or front side) of the wearer. A superior end 21 of the substrate further comprises a fastening means 24 to facilitate removable attachment of the substrate to the helmet 70. As noted supra, such a fastening means may include a hook-and-pile arrangement, a snap, a lace and eyelet configuration, among others. Methods of attachment of the substrate to the v-notched helmet are similar to those attachment methods disclosed supra.

In an embodiment of the invention, the substrate 20 includes means for fastening a substantial length of the periphery of the substrate to substantially the entire periphery comprising the occipital opening or notch defined by the helmet. For example, FIG. 7 depicts fastening means 24 situated along vertical portions of the substrate. Aside from the fastening means discussed supra, other fastening means suitable for this embodiment include buttons, zippers, and tongue and groove mating arrangements such as that used in zip-lock designs. Zipper or tongue and groove mating arrangements confer nearly complete fastening of the substrate to all peripheral areas of the region 72 of the helmet defining the occipital opening. This will assure continual protection to all areas of the occipital region from impact but also from rain, snow, or other detritus that would otherwise weave its way between the substrate and the helmet.

In operation, the wearer of the helmet/substrate combination could determine which type of substrate to couple to which type of helmet, and whether that substrate was to be precooled, or preheated. Then, the wearer attaches the substrate to the helmet, and subsequently dons the helmet. Alternatively, the wearer could first don the helmet, then choose and attach the substrate or have an assistant refresh/substitute substrates as they lose their desired temperature.

Alternatively, the helmet/substrate combination is an integrally molded one. In one embodiment, the device comprises a single homogeneous material such as dense gel or foam. In another embodiment, the device comprises a rigid shell for a helmet irreversibly attached to a substrate comprising relatively reversibly deformable material.

The foregoing description is for purposes of illustration only and is not intended to limit the scope of protection accorded this invention. The present invention may be presented in other specific embodiments without departing from the essential attributes of the present invention. It is apparent that many modifications, substitutions, and additions may be made to the invention while remaining within the scope of the appended claims, which should be interpreted as broadly as possible.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," "more than" and the like include the number recited and refer to ranges which can be subsequently broken down into subranges as discussed above. In the same manner, all ratios disclosed herein also include all subratios falling within the broader ratio.

One skilled in the art will also readily recognize that where members are grouped together in a common manner, such as in a Markush group, the present invention encompasses not only the entire group listed as a whole, but each member of the group individually and all possible subgroups of the main group. Accordingly, for all purposes, the present invention encompasses not only the main group, but also the main group absent one or more of the group members. The present invention also envisages the explicit exclusion of one or more of any of the group members in the claimed invention.

The embodiment of the invention in which an exclusive property or privilege is claimed is defined as follows:

1. A device to protect the neck and the base of the skull of a person, the device comprising:

a) an impact-resistant pliable substrate whereby said substrate is adapted to encircle an extended portion of the person's neck and lower cranium;

b) a helmet configured to cover the skull of the person, except for the occipital region of the skull and lacking a depending edge along the dorsal region of the neck, said helmet adapted to receive said impact-resistant pliable substrate such that the substrate substantially covers the occipital region of the skull; and c) a means for circulating fluid through the substrate.

2. A device to protect the neck and the base of the skull of a person, the device comprising:

a) an impact-resistant pliable substrate whereby said substrate is adapted to encircle an extended portion of the person's neck and lower cranium;

b) a helmet configured to cover the skull of the person, except for the occipital region of the skull and lacking a depending edge along the dorsal region of the neck, said helmet adapted to receive said impact-resistant pliable substrate such that the substrate substantially covers the occipital region of the skull and said substrate extends over the thoracic region of the spine of the wearer so as to continuously cover the cervical- and thoracic-vertebra of the wearer; and c) wherein the substrate further comprises reversibly deformable elongated rods positioned internal of the substrate and extending in a direction parallel to the longitudinal axis of the substrate, wherein the rods are biased to a straight configuration.

3. The device as recited in claim 1 wherein said helmet defines an open region in the shape of an inverted "V" substantially exposing the occipital region.

4. The device as recited in claim 1 further comprising a means for reversibly attaching said substrate to the helmet.

5. The device as recited in claim 1 wherein the substrate has a superior end attached to the helmet and an inferior depending end which is free hanging.

6. The device as recited in claim 5 wherein the depending end includes straps extending from said substrate and comprising means for allowing closure of the straps around a ventral region of the neck.

7. The device as recited in claim 5 wherein the depending end includes straps extending from said substrate and comprising means for allowing closure of the straps around a ventral region of the torso of the wearer.

8. The device as recited in claim 7 wherein the substrate extends to the mid-thoracic region of the person and comprises rigid elongated material encapsulated by the substrate, said elongated material extending parallel to a longitudinal axis $\alpha$ of the substrate.

9. The device as recited in claim 1 wherein said substrate is integrally molded to said helmet.

10. The device as recited in claim 1 wherein said substrate is adapted to removably receive a hot-pack or a cold-pack.

11. The device as recited in claim 1 wherein the substrate continuously covers the cervical region of the spine of the wearer.

12. The device as recited in claim 1 wherein the substrate is adapted to receive a gel.

13. The device as recited in claim 12 wherein the gel is encapsulated by the substrate to create a construct which can be heated or cooled.

14. The device as recited in claim 1 wherein the substrate is adapted to receive gel which can be circulated through the interior of the substrate.

* * * * *